US006575306B1

(12) United States Patent
Schuster et al.

(10) Patent No.: US 6,575,306 B1
(45) Date of Patent: Jun. 10, 2003

(54) INSTALLATION FOR SORTING FLAT ARTICLES

(75) Inventors: Rudolf Schuster, Kirchheim (DE); Josef Romeder, München (DE); Wolfgang Brixius, Neunkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/622,497

(22) PCT Filed: Feb. 16, 1999

(86) PCT No.: PCT/DE99/00416

§ 371 (c)(1),
(2), (4) Date: Aug. 17, 2000

(87) PCT Pub. No.: WO99/42225

PCT Pub. Date: Aug. 26, 1999

(30) Foreign Application Priority Data

Feb. 17, 1998 (DE) ..... 198 06 587

(51) Int. Cl.[7] ..... B65D 21/02
(52) U.S. Cl. ..... 209/706; 220/23.88; 220/23.89
(58) Field of Search ..... 209/706, 702, 209/900; 220/23.87, 23.88, 23.89

(56) References Cited

U.S. PATENT DOCUMENTS 4,895,242 A * 1/1990 Michel ..... 198/365
5,190,162 A * 3/1993 Hartlepp ..... 209/583
5,503,388 A 4/1996 Guenther et al.
5,718,321 A 2/1998 Brugger et al.
5,848,682 A 12/1998 Schuster et al.
5,850,901 A 12/1998 Schuster et al.
5,959,868 A * 9/1999 Oppliger et al. ..... 364/478.14
6,126,017 A * 10/2000 Hours ..... 209/698
6,135,697 A * 10/2000 Isaacs et al. ..... 414/281
6,276,509 B1 * 8/2001 Schuster et al. ..... 198/370.02

FOREIGN PATENT DOCUMENTS

WO WO 95/02467 1/1995
WO WO 97/36805 10/1997

OTHER PUBLICATIONS

Abstract of Japanese Published Application 63202560 of Aug. 22, 1988, *Patent Abstracts of Japan*, vol. 012, No. 484 (M–776), Dec. 16, 1988.

* cited by examiner

*Primary Examiner*—Donald P. Walsh
*Assistant Examiner*—Joseph Rodriguez
(74) *Attorney, Agent, or Firm*—Young & Thompson

(57) ABSTRACT

A sorting installation includes separate collection receptacles into which mail is sorted. The collection receptacles are automatically removed from the output stations of the installation and transported on a transport path to a peripheral transfer mechanism, in which the mail articles are removed from the collection receptacles with the aid of a gripper and are transferred into transport receptacles of the installation. The transfer mechanism is box-shaped and includes a hinged bottom that slides under the mail in the collection receptacles.

8 Claims, 1 Drawing Sheet

INSTALLATION FOR SORTING FLAT ARTICLES

BACKGROUND OF THE INVENTION

The invention relates to a sorting installation for flat mail articles, particularly for letters of varying size and thickness.

A device of this kind is known from EP-C 0 708 691, for example. The sorting mechanism described and represented there is one in which continuously revolving sorting compartments cross a number of parallel sorting pathways. Collecting receptacles for the sorted mail are provided with moving flaps which can be opened in a controllable fashion over the appertaining collection receptacles, so that the mail can drop down into the collection container.

Previously, it was common to place the full receptacle onto a conveyor belt and to replace it with an empty receptacle manually. The full containers were transported on the conveyor belt to a peripheral pick-up station, from where they were delivered to other sorting installations of the operator, for example. It is common to construct such collection receptacles with oblique bottoms in order to facilitate the dropping in of the mail articles from the sorting compartments. In any case, the angle of these bottoms is relatively flat in order to maximize the transport volume of the receptacle.

SUMMARY OF THE INVENTION

The object of the invention is achieved by an improvement in a sorting installation with collection receptacles for receiving flat mail articles, the collection receptacles being inserted into output stations and removed therefrom with the aid of at least one automatic exchange mechanism, the receptacles being equipped with handling aids for the exchange mechanism and the collection receptacles being transported to a peripheral mechanism of the installation. The improvement is that full collection receptacles are placed on a transport path of the installation with the aid of the exchange mechanism and are transported on said path to the peripheral mechanism, the peripheral mechanism of the sorting installation being provided with at least one mechanized transfer station at which mail articles can be removed from the collection receptacles and said collection receptacles are provided with transfer aids for the mail articles. The collection receptacle can be optimally adapted in its design to the sorting, changing, and transport processes in the installation without having to give particular attention to its outer dimensions.

The transport receptacles of the operators now no longer require angled bottoms, thus increasing the usable volume of such receptacles. The installation-specific collection containers are reused immediately subsequent to the emptying process, which keeps their total number low relative to the total number of transport receptacles.

Adapting the receptacle to the operating conditions of the installation makes it possible for its outer dimensions to be larger than those of the corresponding transport receptacle, given an equal intake capacity. But since the collection receptacle is not transported further, this does not give rise to economic disadvantages.

The transfer station makes it possible to transfer the mail articles into the transport receptacles automatically with the aid of specific auxiliary mechanisms that can be optimally adapted to the transfer conditions, so that it is possible to transfer the mail articles in an ordered manner.

By virtue of the collection receptacle having smaller lateral dimensions than the transport receptacle and by having a hinged bottom that can be latched, the collection receptacle can be inserted into the transport receptacle at the transfer station and the bottom can be unlatched to deposit the mail articles as the collection receptacle is lifted out of the transport receptacle so that the transfer into the transport receptacles can be performed with a small installation-related outlay.

The transfer station has at least one hand-shaped gripper which lifts old mail articles out of the collection receptacle or container and inserts the articles into the transport receptacle in one complete bundle. The gripper makes it possible to give the collection receptacle a simple design. It can be designed constructionally and in its movement sequences in such a way that the mail articles can be inserted into the transport receptacles with little interference.

The collection receptacle is a box-type collection receptacle or container having at least one side wall with essentially perpendicularly extending slit-shaped openings for gripping fingers of the gripper. The bottom of the collection receptacle has depressions for the gripper fingers that extend in the direction of grasping and the depressions and openings constitute the transfer aids. The collection receptacle favors the gripper's access to the collected mail articles, with the slit type openings which are open above enabling access from the outside. The bottom of the collection receptacle can be constructed with a comb-shaped cross-section, for example, with rigid type elevations being fashioned between the recesses, on which elevations the mail articles lie. But it is also possible to construct the bottom with pin-shaped elevations in the fashion of a pincushion, which saves material. The gripper fingers can thus be pushed under the mail articles unhindered and can lift them out of the collection receptacle and place them into the transport receptacles in one clutch without internal shifting.

The gripper has downwardly perpendicularly projecting teeth and pivoting fingers, which can be pushed through into the depressions of the bottom through the opening of the receptacle. The side wall opposite the slit-shaped opening has vertically oriented slot-shaped channels which are open to the mail articles and the teeth can be pushed past the mail articles into the channels. The ends of the fingers can be connected or interlocked with the end of the teeth in a detachable way. The comb teeth and the gripper fingers form a stable frame for the mail articles being lifted out. This makes it possible to keep the teeth and the gripper fingers relatively slim, so that the depressions and the channels can be constructed correspondingly flat, and the corresponding wall thicknesses can be kept correspondingly small.

The handling aids of the exchange mechanism are constructed as end walls on the collection receptacles and the gripper elements are arranged centrally at the face sides of the collection receptacles, for example.

The collection receptacle has an oblique bottom which extends at an angle of at least 15° in the direction of the forward drive of the sorting receptacles and the bottom is optimally adapted to the motion for dumping the mail articles onto the sorting compartments. The mail articles now slide definitively against one edge and are kept secure in this position. The angle of inclination of the bottom can equal up to 40°, for example, which raises the height of the collection receptacle accordingly.

DESCRIPTION OF THE PREFERRED EMBODIMENT

Figure 1:
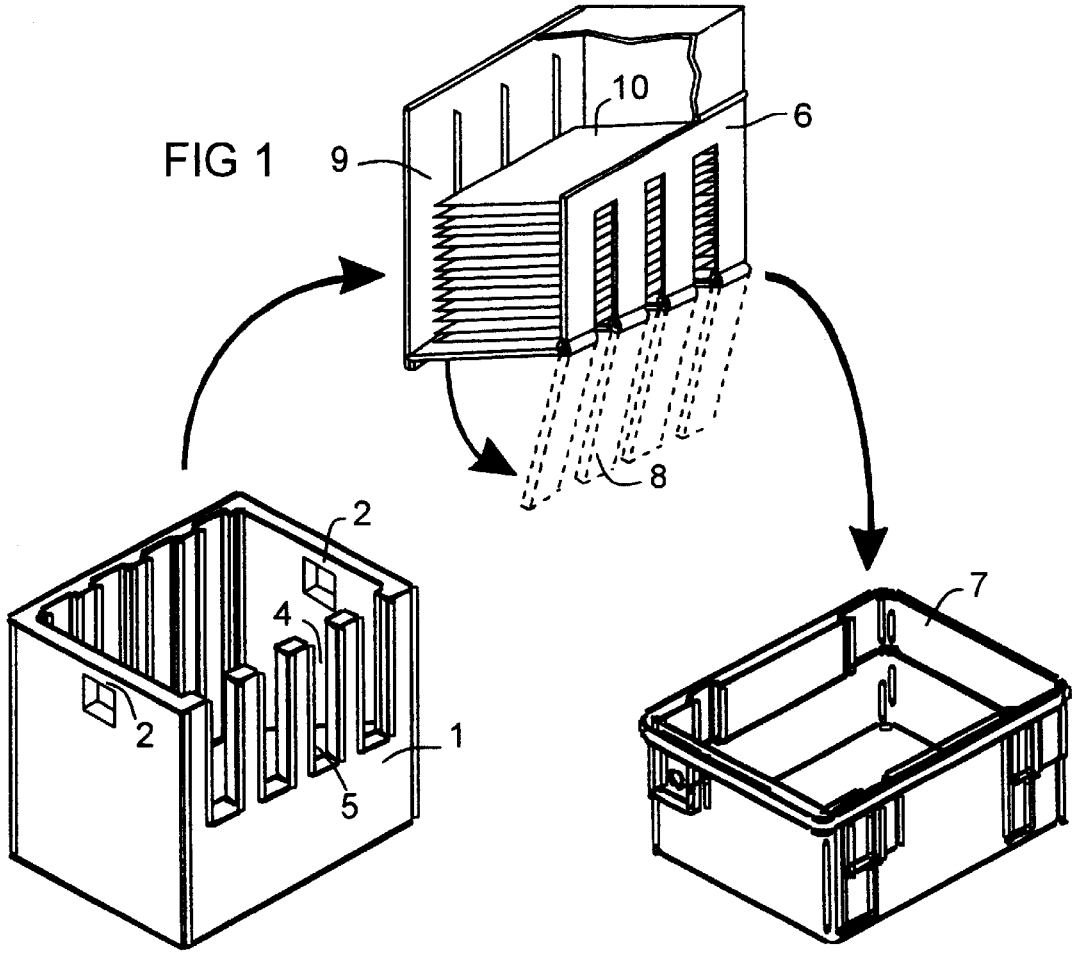
FIG. 1 is a perspective view of a collection receptacle, a gripper, and a transport receptacle at a transfer station.

According to FIG. 1, a collection receptacle 1 which is open above in the fashion of a box is provided with handle type handling aids 2 on two opposite face sides or end walls. A lengthwise sidewall comprises vertical channels 3. On the opposite lengthwise side the sidewall is provided with slit type openings 4 that are open above, extending from the top to a bottom 5 of the collection receptacle 1.

The installation-specific collection receptacle can be inserted into an output station of a sorting installation for letter type flat mail articles and can be transported from there to a transfer station of the sorting installation. In this process, the handling aids 2 serve the changing of receptacles in and out of the output stations with the aid of an exchange mechanism, which is not illustrated.

The transfer station illustrated here in the peripheral region of the installation comprises a movable hand-shaped gripper 6, with the aid of which the mail articles can be extracted from the collection receptacle 1 and inserted into an empty transport receptacle 7 that has been made available in the vicinity. The gripper 6 comprises hinged fingers 8 on the side of the openings 4, which can be pushed through underneath the mail articles located in the collection receptacle 1 through the openings 4. On the opposite side, the gripper 6 is provided with flat teeth that stand up vertically, which can be pushed into channels 3 of the opposite sidewall up to the bottom 5. The driven gripper fingers 8 can be moved up to the bottom ends of the teeth 9 and can hook into these. In this position, the gripper forms a stable carrying frame for the mail articles 10 being lifted out.

The gripper 6 can now be moved over the adjacent transport receptacle 7 and can submerge into this until it makes contact. Next, the interlocking at the ends of the gripper fingers 8 is undone, and these then swing down under the load of the supported mail articles 10 in the subsequent extracting of the gripper 6 from the transport receptacle 7, releasing the enclosed mail articles without mixing them up.

Figure 2:
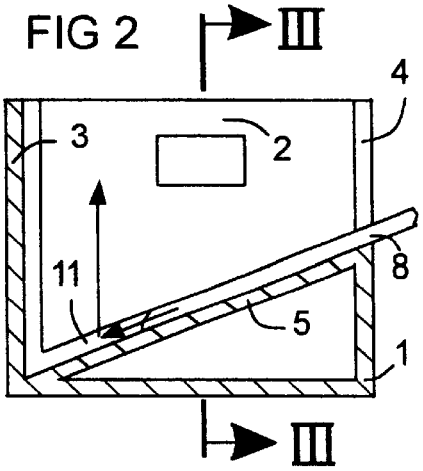
FIG. 2 is a section through the collection receptacle as illustrated in FIG. 1 along the line II/II in FIG. 3.
Figure 3:
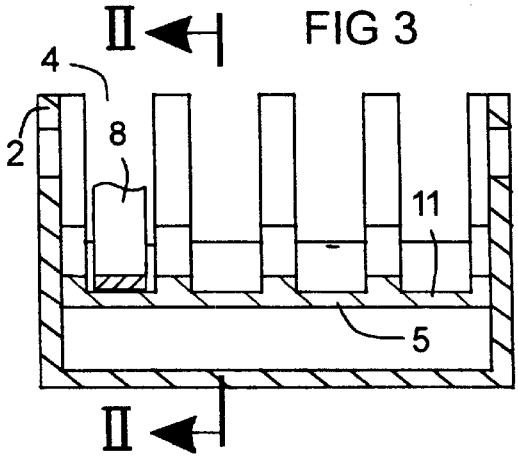
FIG. 3 is a section through the collection receptacle along the line III/III in FIG. 2.

FIGS. 2 and 3 show that the bottom 5 is angled at a sharp rise proceeding from the channels 3 to the opposite openings 4. Groove type depressions 11 of the bottom 5 that extend in this direction produce comb-shaped elevations on which the mail articles can rest. The depressions are so dimensioned that the gripper fingers 8 can be pushed through beneath the mail articles up to the channels 3, where they interlock with the ends of the teeth 9.

What is claimed is:

1. A system for transferring mail, the system comprising:

a collection receptacle that is a first box for receiving mail, said first box having an interior lower surface on which mail rests;

a transfer receptacle that is a second box with smaller dimensions than said first box so as to be insertable into said first box, said second box having a hinged bottom that is insertable beneath said interior lower surface when said second box is inserted into said first box, said hinged bottom having a latch that closes to capture mail resting on said interior lower surface; and a transport receptacle that is a third box with larger dimensions than said second box so that said second box is insertable into said third box, said latch of said hinged bottom being openable in said transport receptacle to release mail captured by said hinged bottom.

2. The system of claim 1, wherein said first box has one side with slits, said interior lower surface has grooves corresponding to said slits, and wherein said hinged bottom comprises fingers that fit through said slits and into said grooves.

3. The system of claim 1, wherein said second box has one side with a lower part on which said hinged bottom is hinged and a second side opposite said first side, said latch being carried by said second side.

4. The system of claim 3, wherein said second side has teeth and wherein said latch comprises a ledge at a lower edge of said teeth.

5. A system for transferring mail, the system comprising:

a collection receptacle that is a first box for receiving mail, said first box having an interior lower surface on which mail rests;

a transfer receptacle that is a second box with smaller dimensions than said first box so as to be insertable into said first box, said second box having a movable hand-shaped gripper bottom that is insertable beneath said interior lower surface when said second box is inserted into said first box to capture mail resting on said interior lower surface; and a transport receptacle that is a third box with larger dimensions than said second box so that said second box is insertable into said third box, said gripper bottom being openable in said transport receptacle to release mail captured by said gripper bottom.

6. The system of claim 5, wherein said first box has one side with slits, said interior lower surface has grooves corresponding to said slits, and wherein said gripper bottom comprises fingers that fit through said slits and into said grooves.

7. The system of claim 5, wherein said second box has one side with a lower part with a hinge from which said gripper bottom depends and a second side opposite said first side, said second side having a latch for closing said gripper bottom.

8. The system of claim 7, wherein said second side has teeth and wherein said latch comprises a ledge at a lower edge of said teeth.

* * * * *